US012636750B2

(12) United States Patent
Klein

(10) Patent No.: US 12,636,750 B2
(45) Date of Patent: May 26, 2026

(54) HONING GUIDE FOR EDGED WORKPIECES

(71) Applicant: Magswitch Technology, Inc., Superior, CO (US)

(72) Inventor: Andrew Klein, Parker, CO (US)

(73) Assignee: Magswitch Automation Company, Superior, CO (US)

( * ) Notice: Subject to any disclaimer, the term of this patent is extended or adjusted under 35 U.S.C. 154(b) by 471 days.

(21) Appl. No.: 18/234,074

(22) Filed: Aug. 15, 2023

(65) Prior Publication Data

US 2024/0058923 A1 Feb. 22, 2024

Related U.S. Application Data

(60) Provisional application No. 63/398,656, filed on Aug. 17, 2022.

(51) Int. Cl.

| | |
|---|---|
| ***B24B 41/06*** | (2012.01) |
| ***B24B 3/36*** | (2006.01) |
| ***B24D 15/06*** | (2006.01) |

(52) U.S. Cl.

CPC ..... *B24B 41/06* (2013.01); *B24B 3/36* (2013.01); *B24D 15/06* (2013.01)

(58) Field of Classification Search

CPC .. B24B 41/06; B24B 3/00; B24B 3/36; B24D 15/00; B24D 15/06

See application file for complete search history.

(56) References Cited

U.S. PATENT DOCUMENTS

| | | | | |
|---|---|---|---|---|
| 4,733,501 | A | 3/1988 | McLean | |
| 2007/0281594 | A1 | 12/2007 | Jones et al. | |
| 2009/0318066 | A1* | 12/2009 | Clay | B24B 3/36 451/367 |
| 2017/0057041 | A1* | 3/2017 | Coyle | B24B 33/00 |

OTHER PUBLICATIONS

Woodcraft; Veritas MK II Honing Guide; from https://www.woodcraft.com/products/veritas-mk-ii-honing-guide; printed May 6, 2022; 18 pages.

Woodsmith; 10 Precision Honing Guides; from https://www.woodsmith.com/article/10-precision-honing-guides/; Jun. 13, 2019; 14 pages.

* cited by examiner

*Primary Examiner* — C. A. Rivera

(74) *Attorney, Agent, or Firm* — Faegre Drinker Biddle & Reath LLP

(57) ABSTRACT

A side-clamp type honing guide provides dual-bevel functionality. The honing guide includes a lever having a first position which positions the blade at a desired angle for a primary bevel, and a second position which easily, reliably and repeatably adjusts the angle of the blade for a second, "micro" bevel after the primary sharpening operation has been completed. The primary and secondary bevels can be imparted to the blade without removal or adjustment of the blade relative to the honing guide, allowing the user to quickly and efficiently toggle between the primary and secondary bevel configurations.

19 Claims, 8 Drawing Sheets

HONING GUIDE FOR EDGED WORKPIECES

RELATED APPLICATION

This application claims the benefit of U.S. Provisional Application No. 63/398,656, filed Aug. 17, 2022, titled HONING GUIDE FOR EDGED WORKPIECES, the entire disclosure of which is expressly incorporated by reference herein.

BACKGROUND

1. Technical Field

The present disclosure relates to blade sharpening tools and, in particular, to a honing guide for edged woodworking tools.

2. Description of the Related Art

Edged tools for woodworking, such as hand planes and chisels, are commonly used to shape workpieces by hand. To work efficiently and effectively with such tools, the cutting edge of the blade must be kept sharp. In many cases, the edge is given a primary bevel angle as well as a secondary "break" along the cutting edge to provide an edge that is sharp enough to cut with ease, but also durable enough to maintain the sharpness of the edge through a number of cuts.

Honing guides and sharpening stones can be used to re-sharpen blades which have become dull or damaged. A honing guide holds the blade at a designated angle relative to the planar surface of the stone, such that the blade may be manually drawn across the stone to re-establish the primary bevel. For a secondary bevel, some guides may be manually reconfigured to alter the bevel angle. In other cases, a separate guide with a different bevel angle may be used.

Honing guides may have a side-clamp or a top-clamp configuration. In a top-clamp configuration, a side edge of a blade is advanced into a slot in the honing guide before being secured to the guide via contact with the wide face between the side edges. In a side-clamp configuration, the wide face of the blade is advanced into an opening before being secured via the side edges.

What is needed is an improvement over the foregoing.

SUMMARY

The present disclosure provides a side-clamp type honing guide with dual-bevel functionality. The honing guide includes a lever having a first position which positions the blade at a desired angle for a primary bevel, and a second position which easily, reliably and repeatably adjusts the angle of the blade for a second, "micro" bevel after the primary sharpening operation has been completed. The primary and secondary bevels can be imparted to the blade without removal or adjustment of the blade relative to the honing guide, allowing the user to quickly and efficiently toggle between the primary and secondary bevel configurations.

In one form thereof, the present disclosure provides a honing guide including a base having a workpiece coupling surface configured to affix to an edged workpiece, a slider connector coupled to the base by a deflectable web, a slider configured to engage with and roll upon a sharpening surface, the slider coupled to the slider connector, and a lever rotatably coupled to one of the base and the slider connector and including a cam. The other of the base and the slider connector has a primary cam surface and a secondary cam surface each configured to selectively engage the cam. The deflectable web biases the cam into engagement with the primary cam surface when the lever is in a first position to define a first angle between the workpiece coupling surface and the slider. The deflectable web biases the cam into engagement with the secondary cam surface when the lever is in a second position to define a second angle between the workpiece coupling surface and the slider, the second angle different from the first angle.

In another form thereof, the present disclosure provides a honing guide including a pair of bases collectively having a pair of dovetails configured to engage an edged workpiece and a workpiece coupling surface adjacent to at least one of the pair of dovetails, a guide upon which each of the pair of bases is mounted and laterally slidable, such that the pair of dovetails can be selectively drawn together to engage opposing edges of the workpiece or spaced apart to release the opposing edges of the workpiece, a roller connector coupled to each of the pair of bases by a deflectable web, and a roller rotatably coupled to each roller connector. The roller is moveable between a primary-bevel position when the deflectable web is in a first deflected position, and a secondary-bevel position when the deflectable web is in a second deflected position spaced from the first deflected position.

In yet another form thereof, the present disclosure provides a method of sharpening a workpiece with a honing guide, including engaging the workpiece with a support surface formed on a base of the honing guide, sliding a slider of the workpiece along the support surface to establish a primary bevel angle, fixing the workpiece to the support surface, and deflecting a portion of the base of the honing guide to adjust the primary bevel angle to a different secondary bevel angle.

BRIEF DESCRIPTION OF THE DRAWINGS

The above mentioned and other features of this invention, and the manner of attaining them, will become more apparent and the invention itself will be better understood by reference to the following description of embodiments of the invention taken in conjunction with the accompanying drawings, where.

Corresponding reference characters indicate corresponding parts throughout the several views. Unless stated otherwise the drawings are drawn to scale and proportional.

DETAILED DESCRIPTION

The embodiments disclosed below are not intended to be exhaustive or to limit the invention to the precise forms disclosed in the following detailed description. Rather, the embodiments are chosen and described so that others skilled in the art may utilize their teachings.

The present disclosure provides a honing guide 20, shown in FIGS. 1-9, which clamps to the side edges across the wide surface of an iron or blade B and is configurable to define two different sharpening angles without adjusting the blade B relative to the guide 20. A pair of levers 48 can placed into a primary position, shown in FIGS. 2 and 8, which positions blade B at a first angle α corresponding to a primary bevel for sharpening blade B upon the working surface of a sharpening stone S. Once the primary bevel is established to a user's satisfaction, the levers 48 can be toggled from the primary position to a secondary position which adjusts the angle of the blade B to angle β larger than angle α, as described in detail below. This allows the user to create a second, or "micro" bevel after the primary sharpening operation has been completed.

Figure 4:
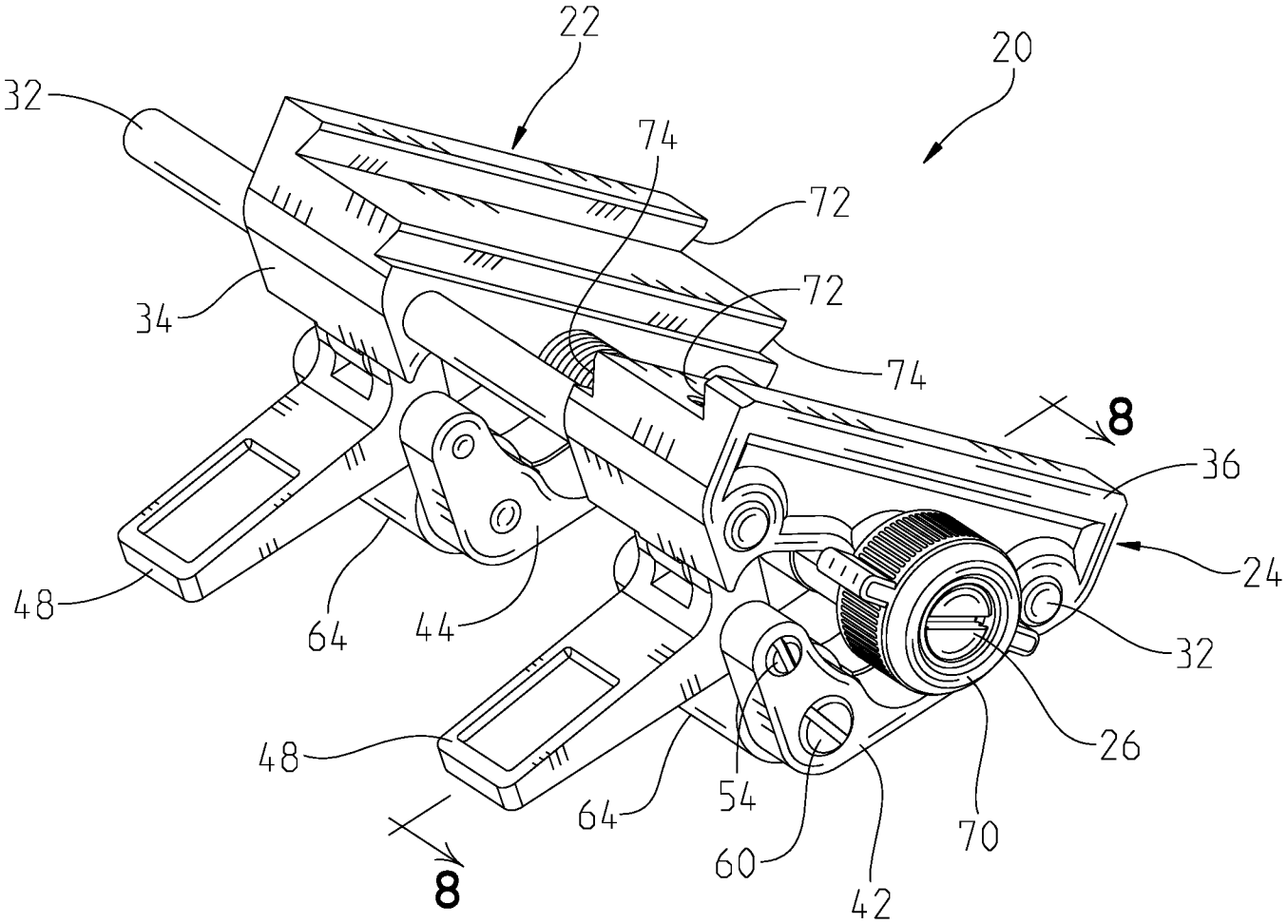
FIG. 4 is a top-right, perspective view of the honing guide shown in FIG. 1.
Figure 5:
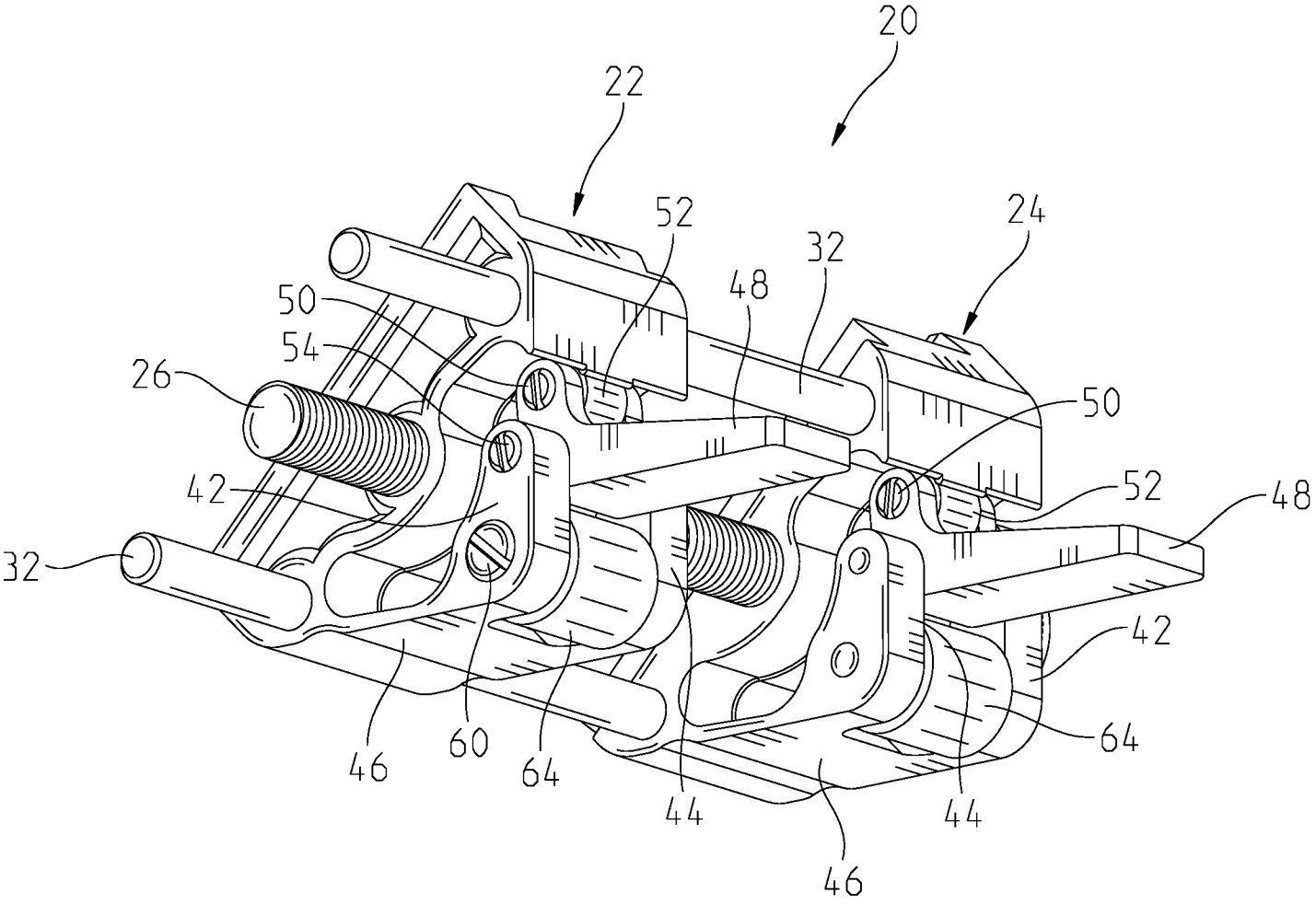
FIG. 5 is a bottom-left, perspective view of the honing guide shown in FIG. 1.

As best seen in FIGS. 4 and 5, honing guide 20 includes left base 22 and right base 24. In this illustrative embodiment, left base 22 and right base 24 are substantially mirror images of one another and, for purposes of the present disclosure, like features or portions of bases 22 and 24 are referred to with like reference numbers.

For purposes of the present disclosure, "left," "right," "upper" and "lower" directionalities are taken from the perspective of a user using the honing guide 20 for a sharpening/honing task, in which the user would generally push forward on the honing guide 20 to advance the cutting edge of the workpiece away from the user's body and across the surface of the stone S. Of course, such directionalities are not absolute and are used only for expedience and consistency in describing the illustrative embodiment of FIGS. 1-9.

Figure 6:
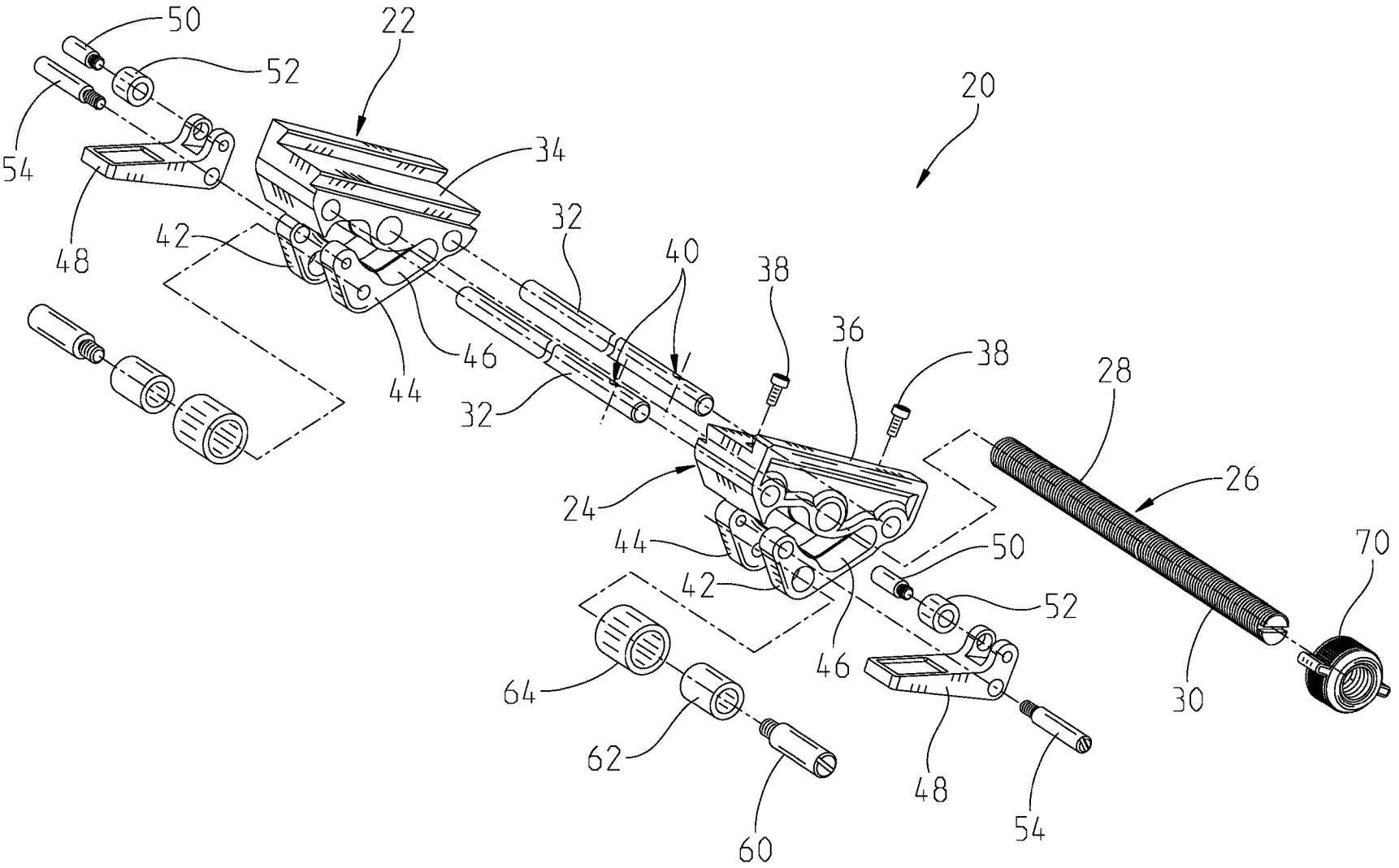
FIG. 6 is an exploded top-right, perspective view of the honing guide shown in FIG. 1.
Figure 9:
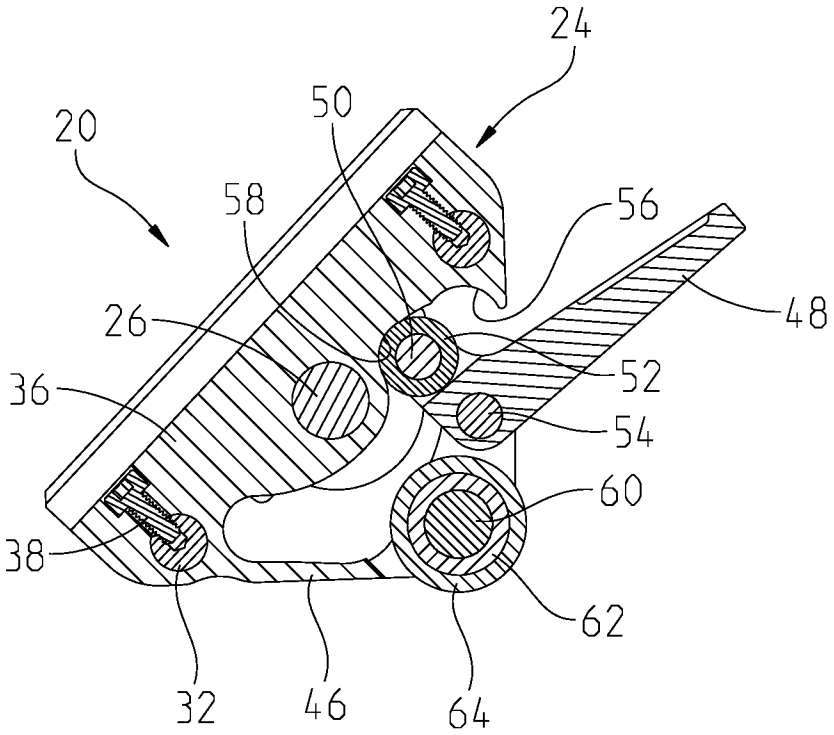
FIG. 9 is another section left elevation view of the honing guide shown in FIG. 1, taken along the line 8-8 in FIG. 4, in which the honing guide is configured to impart a secondary bevel on a workpiece.
Figure 8:
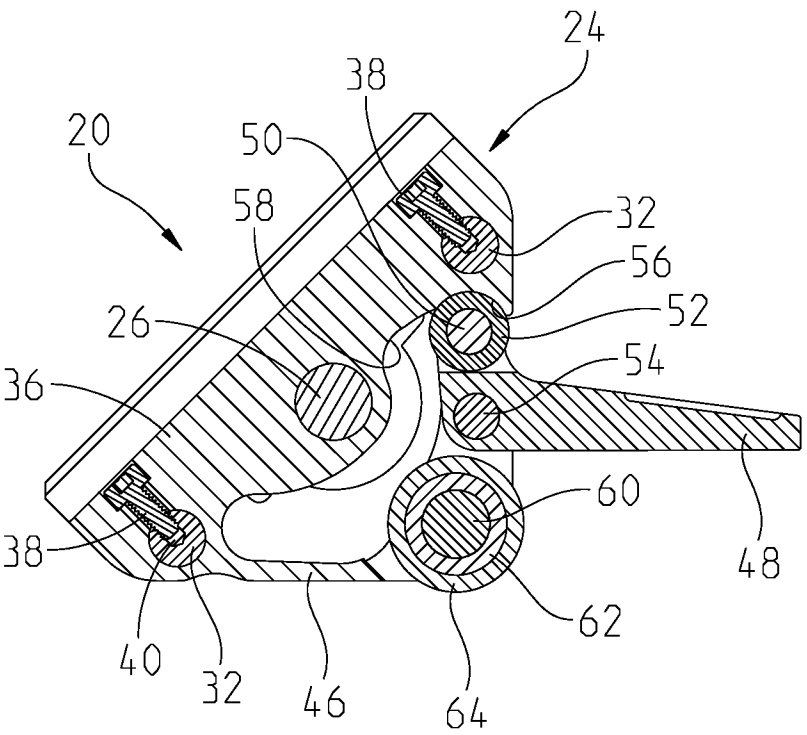
FIG. 8 is a section left elevation view of the honing guide shown in FIG. 1, taken along the line 8-8 in FIG. 4, in which the honing guide is configured to impart a primary bevel on a workpiece.

Each base 22, 24 includes a blade securement portion 34, 36 and a relatively thin, deflectable web 46 extending rearwardly from a bottom portion of the securement portion 34, 36. At the rear end of each web 46 is an outer roller connector 42 and an inner roller connector 44 positioned laterally inward of outer roller connector 42. As best seen in FIGS. 6 and 8-9, roller 64 is positioned between the outer and inner roller connectors 42, 44, such that a roller axle 60 may be passed through the outer connector 42 and the roller 64, and secured (e.g., by a threaded connection) to the inner connector 44. In the illustrated embodiment, a roller bushing 62 is provided between the roller 64 and the axle 60 to provide a lubricious interface for smooth operation. In one exemplary embodiment, roller 64 may be made of a hard, durable material such as steel which is capable of interfacing with a sharpening stone S over a long service life, while bushing 62 may be made of a softer brass material.

Roller 64 allows a user to smoothly advance honing guide 20 across the surface of stone S when sharpening workpiece B, as described further below. However, it is contemplated that other arrangements may be suitable in which roller 64 is replaced by another structure which slides across the surface of stone in another manner, e.g., a stationary low-friction slider. For purposes of the present disclosure, a "roller" is one exemplary type of slider, in that a roller (e.g., roller 64 described above, and cam roller 52 described below) facilitates the sliding movement of two structures relative to one another. Other sliders, such as non-rolling sliders, may also be used in connection with honing guide 20 as required or desired for a particular application.

Figure 7:
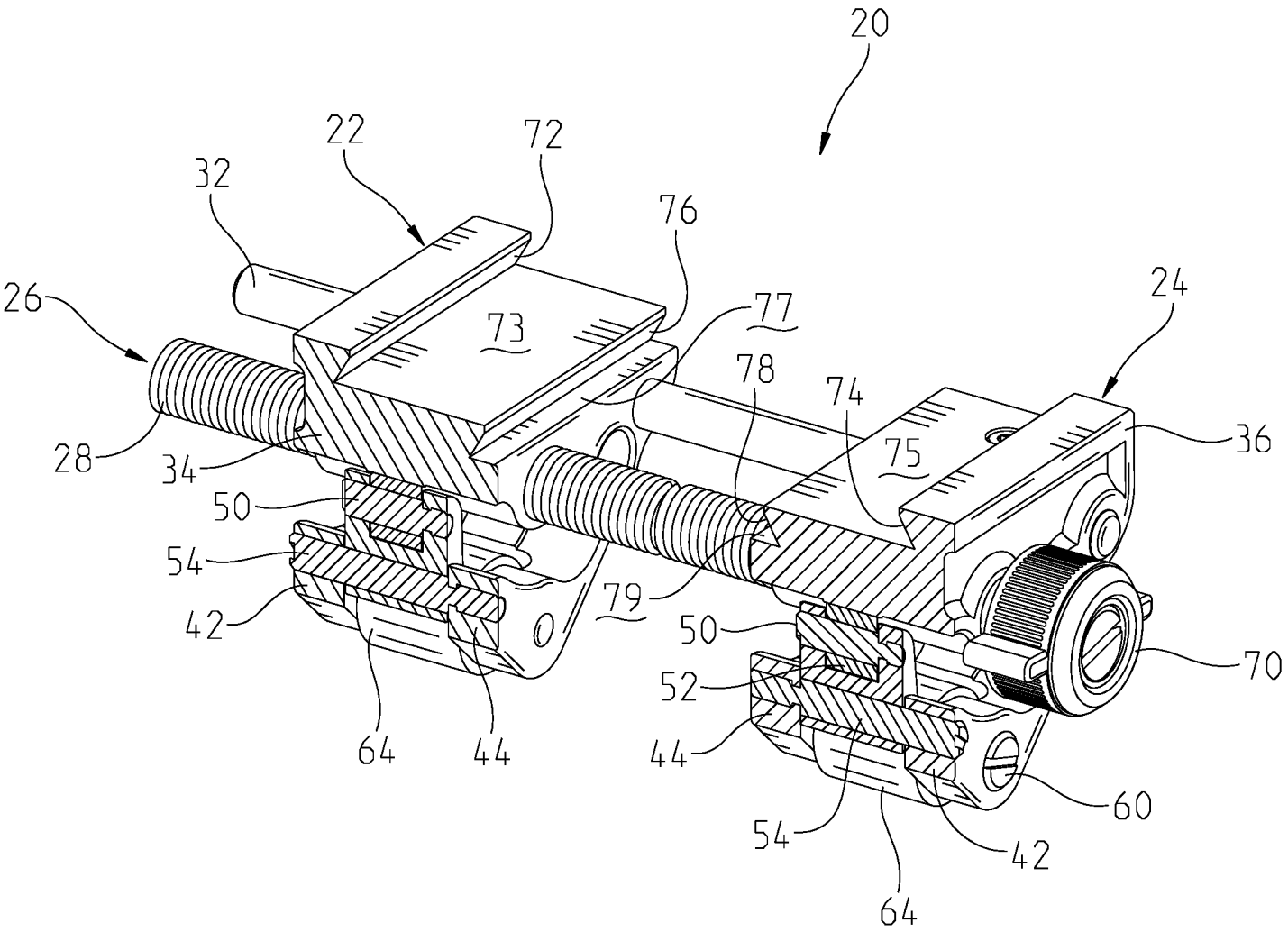
FIG. 7 is a section top-right, perspective view of the honing guide shown in FIG. 1, taken along the line 7-7 in FIG. 3.

Like roller 64, each lever 48 is positioned between and supported by the outer and inner connectors 42 and 44. Referring to FIGS. 6 and 7, lever 48 is pivotably mounted via pivot axle 54, which passes through an aperture in outer connector 42, through an aperture formed in lever 48, and is secured (e.g., by a threaded connection) to inner aperture 44. Each lever 48 includes an actuation arm extending rearwardly from body 22 or 24, and designed for manual actuation by the user of honing guide 20. A cam portion extends at an approximately 90-degree angle from the actuation arm and includes another set of apertures configured to receive cam axle 50.

Figure 2:
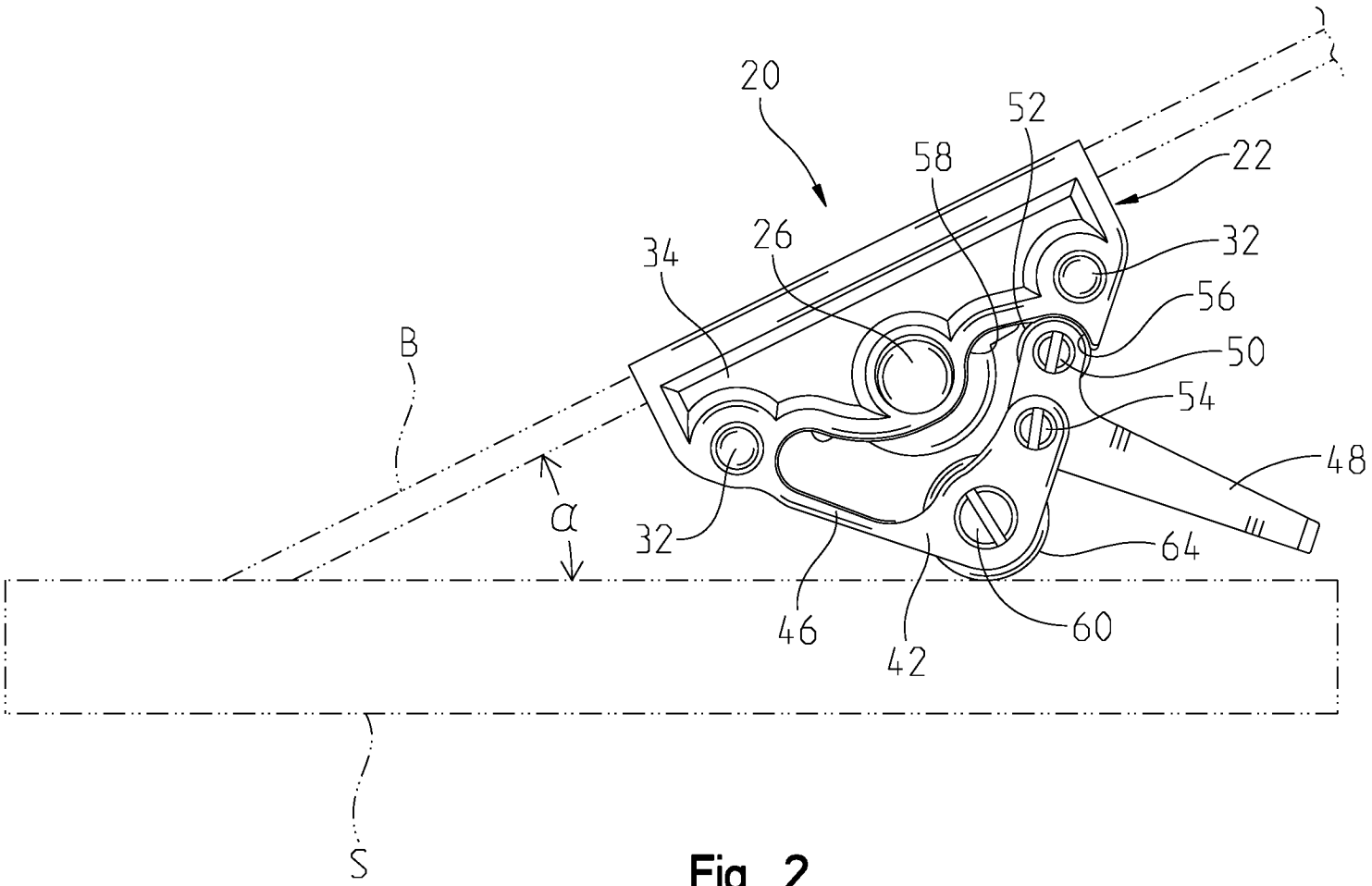
FIG. 2 is a left side, elevation view of the honing guide shown in FIG. 1, configured to impart a primary bevel on the workpiece.

Cam axle 50 rotatably supports cam roller 52, which in one embodiment is a bronze bushing. In the "primary bevel" configuration of honing guide 20 shown in FIGS. 2 and 8, cam roller 52 is biased into engagement with a primary cam surface 56 by a slight deflection of web 46. This slight deflection elastically deforms web 46 to provide the biasing force which firmly seats cam roller 52 into engagement with primary cam surface 56. In this configuration, a first deflection angle α is formed between the workpiece B and the planar surface of the sharpening stone S, as shown in FIG. 2. As further discussed below, this angle α may be set to match a pre-existing bevel on the workpiece B that can then be re-established with a newly sharp edge.

Figure 3:
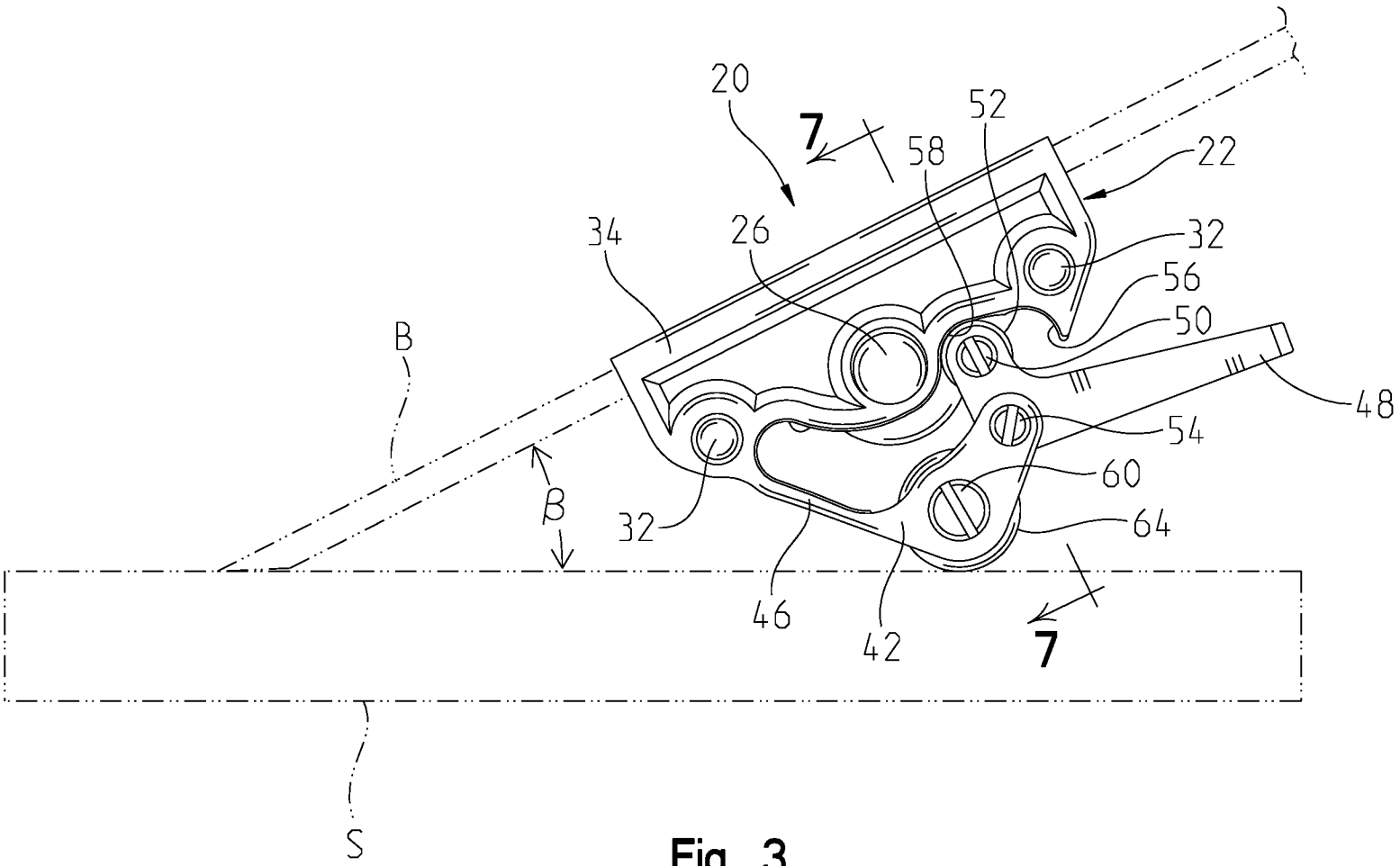
FIG. 3 is another left side, elevation view of the honing guide shown in FIG. 1, configured to impart a secondary bevel on the workpiece.

The honing guide 20 is placed into the "secondary bevel" configuration, shown in FIGS. 3 and 9, by moving lever 48 upwardly against the biasing force provided by web 46. Once cam roller 52 is advanced downwardly and forwardly sufficiently far to clear a small "hump" or protrusion between cam surfaces 56 and 58 best seen in FIG. 9), cam roller 52 seats into the secondary cam surface 58. In this configuration, shown in FIGS. 3 and 9, the roller 64 is positioned lower than in the primary bevel configuration of FIGS. 2 and 8, thereby steepening the angle β (FIG. 3) relative to the angle α (FIG. 2), given that workpiece B has not moved from its fixed position relative to bases 22, 24. This increased angle β allows a secondary bevel to be imparted to the primary bevel, as discussed further below, with a high degree of repeatability and precision.

In the secondary bevel configuration of FIGS. 3 and 9, web 46 has additional elastic deformation as compared with the primary bevel configuration. That is, the web 46 is further deflected into its secondary deflected position, such that it continues to bias cam roller 52 into firm seated engagement with secondary cam surface 58. In one exemplary embodiment, stainless steel may be used together with the illustrated proportions of bases 22, 24 to ensure elastic, and not plastic, deformation occurs during deflections of web 46, thereby minimizing fatigue and ensuring a long service life.

For purposes of illustration, FIGS. 1-9 show one exemplary design in which each cam roller 52 is rotatably coupled to roller connectors 42, 44 and selectively bears upon one of cam surfaces 56, 58 as the lever 48 is toggled. However, lever 48 need not be pivotably connected to roller connectors 42, 44, but could instead be pivotably connected to base 22 (or 24). In this alternative arrangement, each cam roller 52 may be pivotably coupled to base 22 or 24 instead of roller connectors 42, 44, and may bear upon cam surfaces 56, 58 which are formed as a part of roller connectors 42, 44 instead of base 22 or 24. That is, levers 48 may be effectively "flipped" within the scope of the present disclosure. For example, a pivot axle 54 could be secured to bases 22, 24 and cam roller 52 could then bear upon cam surfaces 56, 58 formed on connectors 42, 44.

Honing guide 20 features an adjustable width for compatibility with various workpieces, such as hand plane irons (schematically shown in FIGS. 1-3), chisels or any other blades which have two parallel non-sharped sides edges and a sharpened edge that is substantially perpendicular to the non-sharpened edges.

As best seen in FIGS. 6 and 7, bases 22 and 24 are slidably joined to one another by a pair of guide rods 32. In the illustrated embodiment, guide rods are fixed to base 24 via fasteners 38 which pass through apertures formed in blade-securement portion 36 and threadably engage with apertures 40 respectively formed in guide rods 32. Base 22 is then freely slidable along guide rods 32, but constrained in its sliding motion by lead screw 26.

Lead screw 26 includes two oppositely threaded portions, namely, left portion 28 and right portion 30. Left portion 28 is threadably engaged with a correspondingly threaded aperture in left base 22, while right portion 30 is threadably engaged with a correspondingly threaded aperture in right base 24. Therefore, when lead screw 26 rotates in one direction, bases 22, 24 are spread apart, and when lead screw 26 rotates in the other opposing direction, bases 22, 24 are drawn together. In one embodiment, an adjustment knob 70 is fixed to one end of lead screw 26 (e.g., the right end) to facilitate rotation of the lead screw 26 by the user.

Referring to FIGS. 4 and 7, left base 22 includes a left outer dovetail 72 and a left inner dovetail 76, while right base includes a right outer dovetail 74 and a right inner dovetail 78. Left and right outer dovetails 72, 76 cooperate to fix engage relatively wider workpieces B to honing guide 20, such as block plane irons, while left and right inner dovetails 74, 78 cooperate to fix engage relatively narrower workpieces B to honing guide 20, such as chisels. Each dovetail 72, 74, 76, 78 has a respective adjacent planar workpiece support and coupling surface 73, 75, 77, 79, as shown in FIG. 7. Each of the coupling surfaces 73, 75, 77, 79 is configured to abut and affix to the workpiece B when bases 22 and 24 are drawn together to "squeeze" the workpiece between one of the pairs of dovetails. As best seen in FIG. 7, dovetails 72, 74, 76, 78 define angular surfaces designed to urge the workpiece into firm abutting contact with the adjacent planar support and coupling surface 73, 75, 77 or 79.

Alternative designs may include angled dovetails 72, 74, 76 or 78 which allow for sharpening of workpieces B having sharpened edges which are non-perpendicular to the non-sharped sides. For example, 18 degree and 30 degree chisels are common in the industry, and dovetails 76, 78 could be angled to accommodate such tools. Additionally, bases 22, 24 may include tapped holes or another fixation mechanism configured to accept and fix separate plates or jigs having the desired angles upon honing guide 20.

For purposes of illustration, FIGS. 1-9 show the use of a pair of bases 22, 24 and associated components, which allows for width-adjustable mounting to workpiece B as described above. However, it is contemplated that alternative designs may include a single base 22 with an alternative mechanism for affixing workpiece B, such as with screws or a separately mounted clamping mechanism, as required or desired for a particular application.

Figure 1:
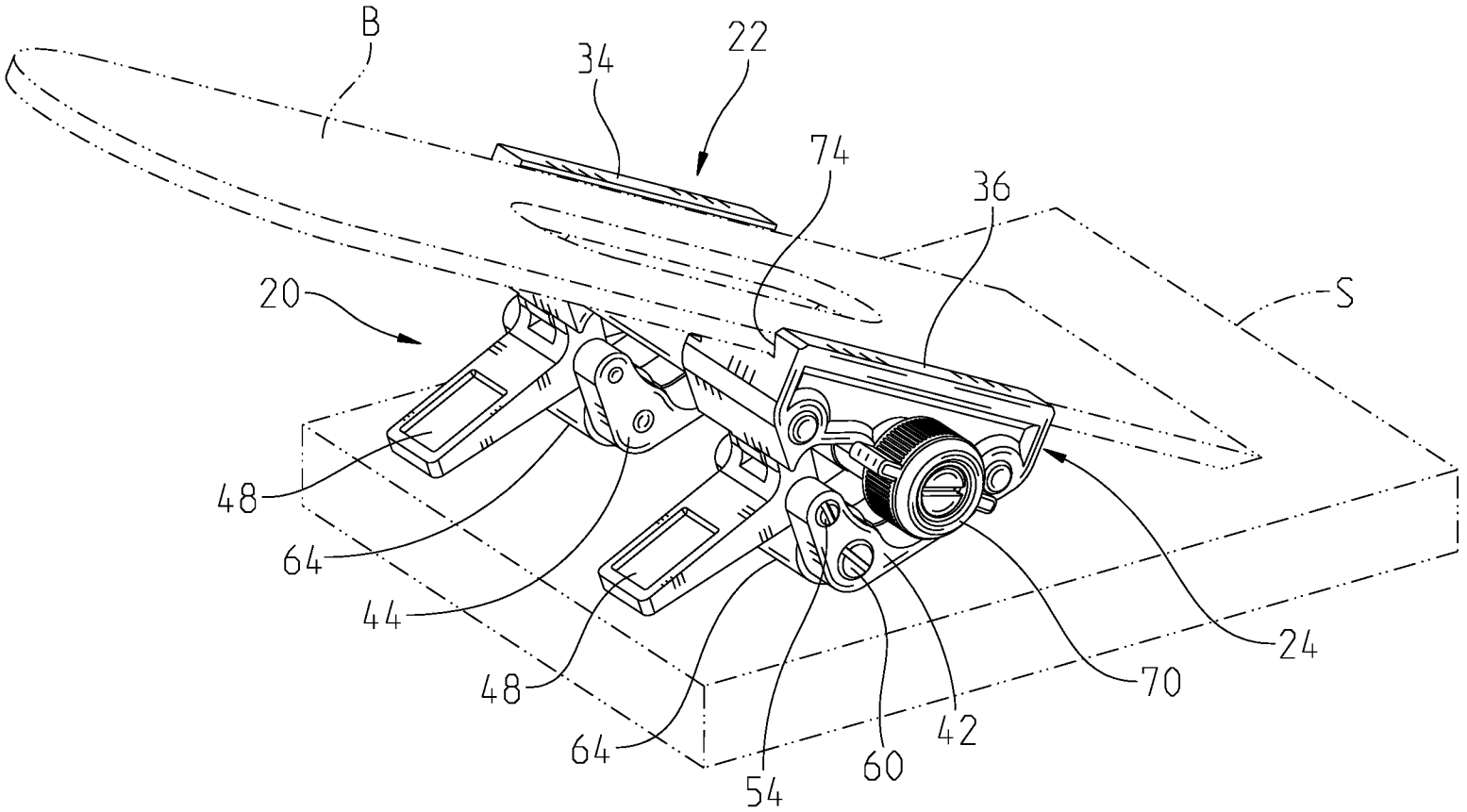
FIG. 1 is a perspective view of a honing guide made in accordance with the present disclosure, shown engaged with a schematic workpiece and sharpening stone.

In use, a user selects the primary bevel angle by sliding the workpiece B forwardly or rearwardly to a desired position relative to honing guide 20 (and particularly, relative to roller 64). In some cases, the user may position the workpiece to place a pre-existing primary bevel into flush contact with the sharpening stone S while rollers 64 are also in firm contact (FIG. 1). In some embodiments, a jig may be provided to provide a positive stop for the workpiece B at selected, predetermined bevel angles.

Once the desired position of workpiece B is established, the user can adjust the width of the space between the bases 22, 24 by turning knob 70. When the width between a selected pair of dovetails 72, 74 or 76, 78 is wider than the width of the workpiece B, the workpiece B may be placed into contact with the adjacent top surfaces of the bases 22, 24, i.e., the workpiece B is "top loaded" into the honing guide 20 by lowering the workpiece B into contact with the honing guide 20 along a direction at least partially perpendicular to the cutting edge of the workpiece B. The knob 70 is then turned in the opposite direction to draw the bases 22, 24 back toward one another. As the selected pair of dovetails 72, 74 or 76, 78 engage the parallel non-sharpened edges of the workpiece B as shown in FIG. 1, the workpiece B becomes fixed to honing guide 20 and in firm, fixed and abutting contact with the upper planar coupling surfaces 73, 75 or 77, 79 of blade-securement portions 34, 36. This clamping along the non-sharpened edges establishes the "side clamp" configuration of honing guide 20

The user can re-establish (or modify) the original primary bevel by drawing or pushing the workpiece B across the stone S while maintaining contact between the stone S and rollers 64.

After the primary bevel is complete, a smaller secondary bevel may be imparted to the cutting edge. As noted above, the user may simply toggle the levers 48 to steepen the angle between the workpiece B and the stone S (e.g., from angle $\alpha$ to angle $\beta$ as shown in FIGS. 2 and 3 respectively). This angular adjustment is accomplished while maintaining the fixed relationship between workpiece B and the blade-securement portions 34, 36, ensuring that the secondary bevel has precisely the intended, predetermined additional bevel angle relative to the primary bevel. The user can then impart the desired secondary bevel by again drawing or pushing the workpiece B across the stone S while maintaining contact between the stone S and rollers 64.

When the cutting edge of the workpiece B is sharpened to the satisfaction of the user, workpiece B may be released from honing guide 20 by simply turning adjustment knob 70 to move bases 22, 24 apart and allow the workpiece B to be withdrawn from dovetails 72, 74 or 76, 78.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A honing guide comprising:

a base having a workpiece coupling surface configured to affix to an edged workpiece;

a slider connector coupled to the base by a deflectable web;

a slider configured to engage with and roll upon a sharpening surface, the slider coupled to the slider connector; and a lever rotatably coupled to one of the base and the slider connector and including a cam, the other of the base and the slider connector having a primary cam surface and a secondary cam surface each configured to selectively engage the cam, wherein the deflectable web biases the cam into engagement with the primary cam surface when the lever is in a first position to define a first angle between the workpiece coupling surface and the slider, and wherein the deflectable web biases the cam into engagement with the secondary cam surface when the lever is in a second position to define a second angle between the workpiece coupling surface and the slider, the second angle different from the first angle.

2. The honing guide of claim 1, wherein the deflectable web defines a first elastically deformed configuration when the lever is in the first position and a second elastically deformed configuration when the lever is in the second position, the first elastically deformed configuration different from the second elastically deformed configuration.

3. The honing guide of claim 1, wherein the slider is a roller rotatably coupled to the slider connector.

4. The honing guide of claim 3, wherein the lever is pivotably coupled to the slider connector.

5. The honing guide of claim 4, wherein the cam comprises a cam roller rotatably coupled to the lever.

6. The honing guide of claim 4, wherein the slider connector includes an outer connector and an inner connector, the roller and the lever positioned between the inner and outer connector.

7. The honing guide of claim 1, wherein the base includes a pair of dovetails positioned adjacent to the workpiece coupling surface, the pair of dovetails configured to clamp to non-sharpened edges of the workpiece such that a face of the workpiece abuts the workpiece coupling surface.

8. A honing guide comprising:

a pair of bases collectively having a pair of dovetails configured to engage an edged workpiece and a workpiece coupling surface adjacent to at least one of the pair of dovetails;

a guide upon which each of the pair of bases is mounted and laterally slidable, such that the pair of dovetails can be selectively drawn together to engage opposing edges of the workpiece or spaced apart to release the opposing edges of the workpiece;

a roller connector coupled to each of the pair of bases by a deflectable web; and a roller rotatably coupled to each roller connector, wherein the roller is moveable between a primary-bevel position when the deflectable web is in a first deflected position, and a secondary-bevel position when the deflectable web is in a second deflected position spaced from the first deflected position.

9. The honing guide of claim 8, further comprising:

a lever rotatably coupled to the roller connector and including a cam, each of the pair of bases having a primary cam surface engaged by the cam when the lever is in a first position and a secondary cam surface engaged by the cam when the lever is in a second position, wherein the deflectable web biases the cam into engagement with the primary cam surface when the lever is in the first position to define a first angle between the workpiece coupling surface and the roller, and wherein the deflectable web biases the cam into engagement with the secondary cam surface when the lever is in the second position to define a second angle between the workpiece coupling surface and the roller, the second angle different from the first angle.

10. The honing guide of claim 8, wherein the deflectable web defines a first elastically deformed configuration in the primary-bevel position and a second elastically deformed configuration in the secondary-bevel position.

11. The honing guide of claim 8, further comprising a lead screw threadably coupled to each of the pair of bases, the lead screw having a first portion engaged with a first one of the pair of bases and having a first threaded portion, and a second portion engaged with a second one of the pair of bases and having a second threaded portion, the first threaded portion and the second threaded portion oppositely threaded such that rotation of the lead screw in a first direction draws the pair of bases together and rotation of the lead screw in a second, opposing direction spread the pair of bases apart.

12. The honing guide of claim 11, further comprising an adjustment knob fixed to an end of the lead screw.

13. The honing guide of claim 8, wherein the pair of dovetails comprises an outer pair of dovetails, the pair of bases collectively having an inner pair of dovetails positioned laterally inwardly of the outer pair of dovetails.

14. The honing guide of claim 8, wherein the outer pair of dovetails are parallel to one another and the inner pair of dovetails are parallel to one another.

15. A method of sharpening a workpiece with a honing guide, comprising:

engaging the workpiece with a support surface formed on a base of the honing guide;

sliding a slider of the honing guide along the support surface to establish a primary bevel angle; fixing the workpiece to the support surface; and deflecting a portion of the base of the honing guide to adjust the primary bevel angle to a different secondary bevel angle:

wherein the step of deflecting comprises moving a cam from a first cam surface in which a deflectable web is in a first position biasing the cam toward the first cam surface, to a second cam surface, in which the deflectable web is in a second position biasing the cam toward the second cam surface.

16. The method of claim 15, wherein the step of sliding the workpiece comprises placing a pre-existing bevel angle into flush contact with a surface of a sharpening stone while the slider of the honing guide is in contact with the surface.

17. The method of claim 15, wherein the base comprises a first base and a second base laterally slidable relative to the first base, the step of fixing the workpiece comprising advancing the second base toward the first base to engage a pair of dovetails with non-sharpened edges of the workpiece.

18. The method of claim 17, wherein the step of advancing the second base toward the first base is accomplished by rotating a lead screw respectively engaged with the first base and the second base.

19. The method of claim 15, wherein the step of moving the cam comprises pivoting a lever from a first position to a second position.

* * * * *